US005593045A

United States Patent [19]

Eldon, III et al.

[11] Patent Number: 5,593,045

[45] Date of Patent: Jan. 14, 1997

[54] EYEGLASS AND EYEGLASS FRAME DISPLAY FIXTURE AND SYSTEM

[75] Inventors: James B. Eldon, III, Barto; Richard J. Winig, Bluebell; Alan M. Winig, Lafayette Hill, all of Pa.

[73] Assignee: Eye Designs, Inc., Norristown, Pa.

[21] Appl. No.: 304,385

[22] Filed: Sep. 12, 1994

[51] Int. Cl.[6] ..... A47F 5/00

[52] U.S. Cl. ..... 211/13; 211/87; 248/902; 248/222.12; 248/222.51; 248/225.21

[58] Field of Search ..... 211/13, 87, 106, 211/59.1, 57.1; 248/902, 220.31, 221.11, 222.12, 222.13, 222.51, 225.21

[56] References Cited

U.S. PATENT DOCUMENTS

| | | | |
|---|---|---|---|
| 1,421,196 | 6/1922 | Fennimore . | |
| 2,096,319 | 10/1937 | Churchill | 248/222.12 X |
| 2,240,225 | 4/1941 | Place | 248/222.51 |
| 2,498,623 | 2/1950 | Poupitch | 248/222.51 X |
| 2,640,672 | 6/1953 | Bedford | 248/222.51 X |
| 2,852,829 | 9/1958 | Holton et al. | 248/222.12 X |
| 2,909,352 | 10/1959 | van Buren | 248/222.51 X |
| 3,154,281 | 10/1964 | Frank | 248/222.12 X |
| 3,229,944 | 1/1966 | Everburg | 248/223 |
| 3,924,750 | 12/1975 | Dunchock | 211/13 |
| 4,168,067 | 9/1979 | Wiczer | 248/222.12 X |
| 4,204,602 | 5/1980 | Dunchock | 211/13 |
| 5,018,253 | 5/1991 | Oppenheimer | 24/458 |
| 5,025,931 | 6/1991 | Berger | 211/13 |
| 5,056,668 | 10/1991 | Berger | 211/13 |
| 5,069,416 | 12/1991 | Ennis | 248/902 |
| 5,085,388 | 2/1992 | Creutz | 248/288.5 |
| 5,144,345 | 9/1992 | Nyman | 351/41 |
| 5,176,262 | 1/1993 | Zoueki | 211/13 |
| 5,255,796 | 10/1993 | Josephson | 211/13 |
| 5,316,252 | 5/1994 | Charnow et al. | 248/902 X |

OTHER PUBLICATIONS

Dispensing Equipment, vol. XX, No. 21, Frames Data, Inc., Irvine, CA, 1992–1993.

The Versa–Clip By Eye Designs, 1989.

*Primary Examiner*—Robert W. Gibson, Jr.

*Attorney, Agent, or Firm*—Eckert Seamans Cherin & Mellott

[57] ABSTRACT

A display system has removable fixtures for supporting eyeglasses, eyeglass frames and similar manufactured articles in a display configuration on a substantially vertical display panel. A fixture has a forward end adapted to hold the eyeglasses, eyeglass frames or other article in an attractive display position and a rear end adapted to secure the fixture releasably to an aperture in the display panel. The rear end of the fixture has a face plate that contacts the front surface of the display panel around the periphery of the aperture, a pair of opposed side lugs and a flanged top clip dimensioned to fit in the aperture and engage the periphery of the aperture and the rear surface of the display panel. The fixture is attached by inserting the flanged top clip and pressing rearwardly until the side lugs engage the display panel. The side lugs can have inclined bottom edges that bear against the bottom edge of the aperture, forcing the top clip against the opposite edge. This secures the attachment against downward pressure on the fixture and allows the fixture to be readily detached by upward pressure.

28 Claims, 6 Drawing Sheets

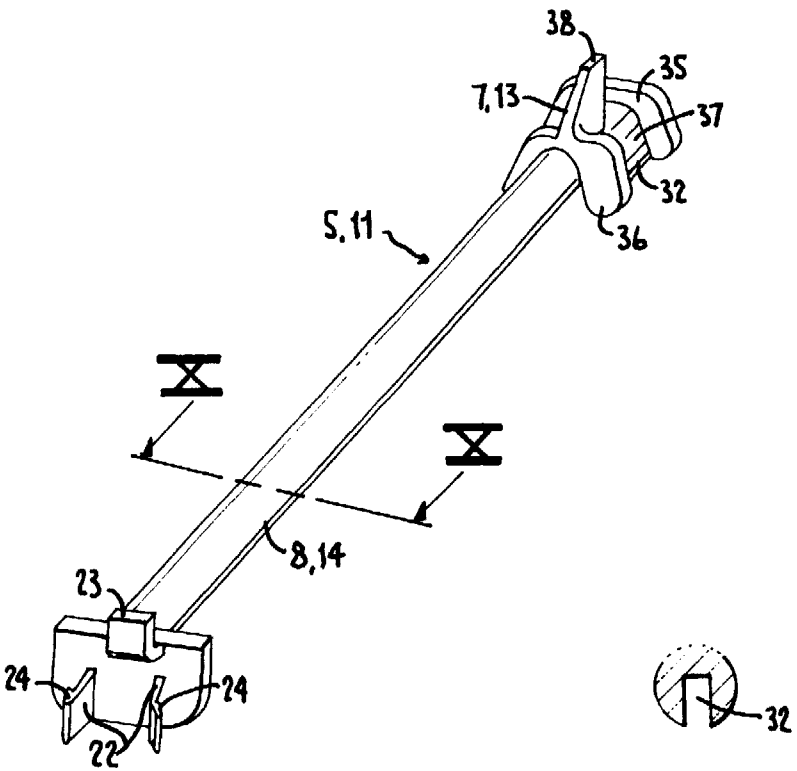
Fig. 9.
Fig. 10.
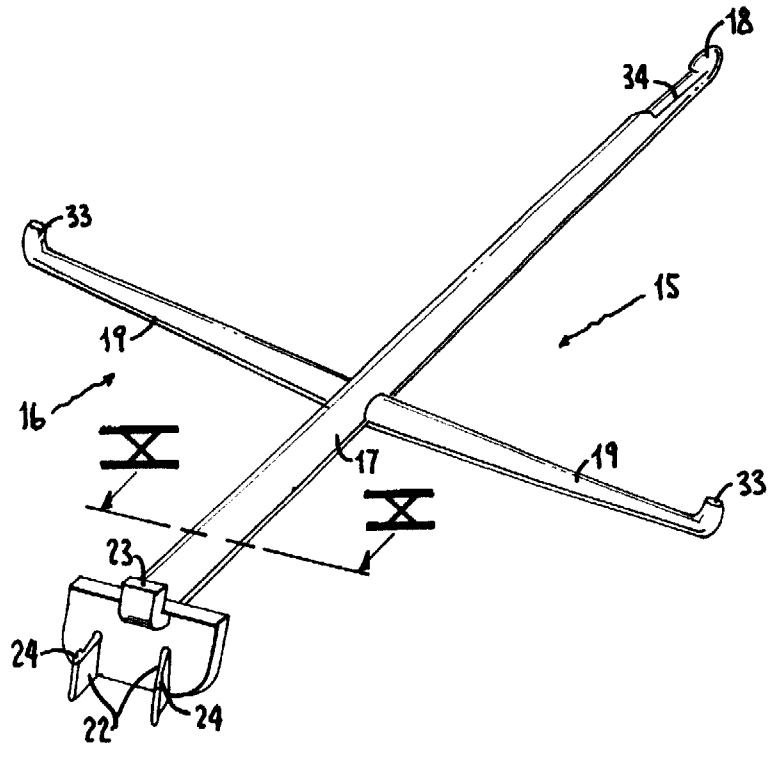
Fig. 8.

EYEGLASS AND EYEGLASS FRAME DISPLAY FIXTURE AND SYSTEM

1. FIELD OF THE INVENTION

The invention relates to fixtures and a system for mounting and displaying articles of manufacture such as eyeglasses, eyeglass flames or similar articles on a display panel, for example in a retail store display. The invention provides fixtures removably coupleable to a panel for displaying a large number of eyeglass flames, complete eyeglasses or the like on a wall display or stand in a showroom or office. The supporting structures of the display are unobtrusive to allow prospective buyers to examine the flames or the eyeglasses from a number of different perspectives. The system includes a detachable fixture mounting arrangement for supporting eyeglasses or flames or other objects, and a security band or cable arrangement to lock the objects to the fixtures against inadvertent upset when on display.

2. BACKGROUND OF THE INVENTION

In the optical business, it is desirable to display a large variety of eyeglasses and eyeglass frames in a manner that is attractive and allows the prospective buyer easily to examine and compare a large number of different frames or eyeglasses. Advantageously, the frames or eyeglasses are supported such that they are readily seen from different perspectives. The supporting structure should not unduly interfere with the view of the frames or eyeglasses, and should make it easy for the customer to try them on, with minimal danger of upsetting other frames. A wide variety of such displays are known, examples being disclosed in the following U.S. patents:

| | | |
|---|---|---|
| 1,421,196 | Fennimore | 1922 |
| 3,229,944 | Everburg | 1966 |
| 3,924,750 | Dunchock | 1975 |
| 4,204,602 | Dunchock | 1980 |
| 5,018,253 | Oppenheimer | 1991 |
| 5,025,931 | Berger | 1991 |
| 5,056,668 | Berger | 1991 |
| 5,069,416 | Ennis | 1991 |
| 5,085,388 | Cruetz | 1992 |
| 5,144,345 | Nyman | 1992 |
| 5,176,262 | Zoueki | 1993 |
| 5,255,796 | Josephson | 1993 |

Eyeglasses and/or frames have a peculiar structure, namely that needed to fit in place on the wearer's head. Thus, the frames have temple pieces to engage over a wearer's ears pivotally coupled to a lens support that typically has spaced pads to fit the bridge of the nose. These aspects are common to frames without lenses, sample frames with plain glass lenses, finished eyeglasses, sunglasses, reading glasses, goggles and the like, and the present invention is applicable to all these types, as well as other articles having similar needs or attributes.

It may be desirable to display frames with the temple pieces folded wholly or partly closed against the lens frame, or alternatively, folded open to the position they occupy in use. The fixtures supporting the frames should admit of such alternatives, and should also be arranged to hold the frames in an attractive array. Potential purchasers typically make their selection of eyeglass frames very carefully, and an attractive but unobtrusive supporting fixture is important. While the eyeglass and eyeglass frame displays disclosed in the foregoing patents include a variety of different types of display structures, it would still be desirable to improve on the supporting structures to provide a display system that is more sturdy, light weight, simple but versatile, unobtrusive, attractive, inexpensive and easy to install. It would further be desirable to provide a security system for eyeglasses or eyeglass frames when displayed on supporting structures that secures the frames to the supporting structures such that the frames cannot be casually upset, for example when reaching for an adjacent frame in a compact array.

3. SUMMARY OF THE INVENTION

It is an object of this invention to provide a new and improved display system and fixture for the display of eyeglasses and eyeglass frames or other manufactured articles.

It is another object of this invention to provide a display system and fixture that is easily removed and attached to a display panel for installation or for varying the display between alternative fixtures for holding different types of articles or articles in different display modes.

It is a further object of the invention to provide a display system and fixture that is sturdy when used for displaying manufactured articles such as eyeglasses, eyeglass frames, or other manufactured articles, but is also unobtrusive.

It is still another object of this invention to provide a display system and fixture that is simple in design and economical to manufacture and use, yet provides a versatile means for customizing arrays.

It is yet another object of this invention to provide a security system that secures eyeglasses and eyeglass frames on a fixture attached to a display system.

According to the invention, these and other objects are accomplished by a display system and fixtures for manufactured articles, such as eyeglasses and eyeglass frames (herein sometimes simply termed "frames"), including a display panel, preferably a generally vertical display panel, with at least one aperture formed therein, preferably a plurality of spaced apertures, and at least one article holding fixture, preferably a plurality of article holding fixtures, attached to the aperture(s) of the display panel. Each fixture includes a forward end adapted to hold the manufactured article in a position for display and a rear end having a face plate adapted to contact the front surface of the display panel around the periphery of a selected aperture, the face plate having either at least two lugs, or at least two flanged clips, or at least one lug and at least one flanged clip, but preferably having a pair of side lugs and a flanged top clip adapted to fit within the selected aperture and to engage portions of the periphery of the aperture and the rear surface of the display panel to releasably secure the fixture to the display panel.

For eyeglasses and eyeglass frames, the forward end of the fixture may include a generally T-shaped forwardly extending portion including an elongated rod portion preferably having a slot at the forward nose end for supporting the nose bridge of the frames and elongated cross arms bisecting the rod portion along the length thereof and preferably having vertically extending fins thereon for supporting eyeglasses and eyeglass frames in an opened templar side arm position.

A security band or cable can also be provided for the generally T-shaped fixture including an elongated band or cable of resilient flexible material having a band portion at one end and a locking retainer portion with a locking pin at the other end. The nose bridge of an eyeglass or eyeglass frame once positioned on the forward nose end of the fixture can then be secured to the fixture by being positioned between the band and retainer portions of the security cable attached to the fixture, thereby causing the cable portion to form an arch over the nose bridge of the frames to lock the frames in place.

The forward end of the fixture for eyeglasses and eyeglass frames may also include a generally horseshoe-shaped forwardly extending portion including an elongated rod portion having at the forward end a nose piece including two spaced apart, forward and rear, inverted U-shaped members adjoined by an inverted U-shaped nesting member for supporting the nose bridge of the frames and also including a vertically extending fin on the rear member for supporting eyeglasses and eyeglass frames in a folded and/or opened templar side arm position.

4. BRIEF DESCRIPTION OF THE DRAWINGS

There are shown in the drawings certain exemplary embodiments of the invention. It should be understood that the invention is not limited to these embodiments, and is capable of variation within the scope and spirit of the appended claims. In the drawings, FIG. 1 is an isometric drawing of a preferred embodiment of the invention, illustrating three different types of fixtures of the invention used for displaying eyeglasses and eyeglass frames or other accessories such as signs in a display system of the invention;

FIG. 8 is an isometric view of one embodiment of the invention, showing the rear end of a fixture of the invention that fits into and engages an aperture in a display panel of the display system of the invention and the front end of the fixture that is used for displaying eyeglasses and eyeglass frames in an opened templar side arm position;

FIG. 9 is an isometric view of another embodiment of the invention, showing the rear end of a fixture of the invention that fits into and engages an aperture in a display panel of the display system of the invention and the front end of the fixture that is used for displaying eyeglasses and eyeglass frames in a folded and/or opened templar side arm position;

FIG. 10 is a cross-section view along lines X—X of both FIGS. 8 and 9 showing a channel in the fixture of the invention;

5. DETAILED DESCRIPTION OF THE PREFERRED EMBODIMENTS OF THE INVENTION

The invention provides a novel display system and fixtures for showcasing articles of manufacture such as eyeglasses and eyeglass frames and other accessories, which is sturdy, light weight, easy to assemble and disassemble, as well as unobtrusive, inexpensive, versatile and attractive. This is accomplished using one or more removable supporting fixtures that protrude from a preferably-vertical support panel, the fixtures being removably engaged in openings or apertures in the support panel. A pattern of openings is provided for supporting an array of eyeglasses and/or eyeglass frames, as well as other accessories, and the alternative fixtures can be provided for supporting the eyeglasses and eyeglass frames in different display modes, e.g., with the templars folded or extended, or for supporting other accessories, such as signs, shelves, photographs, lenses, lens tints, or the like.

Figure 1:
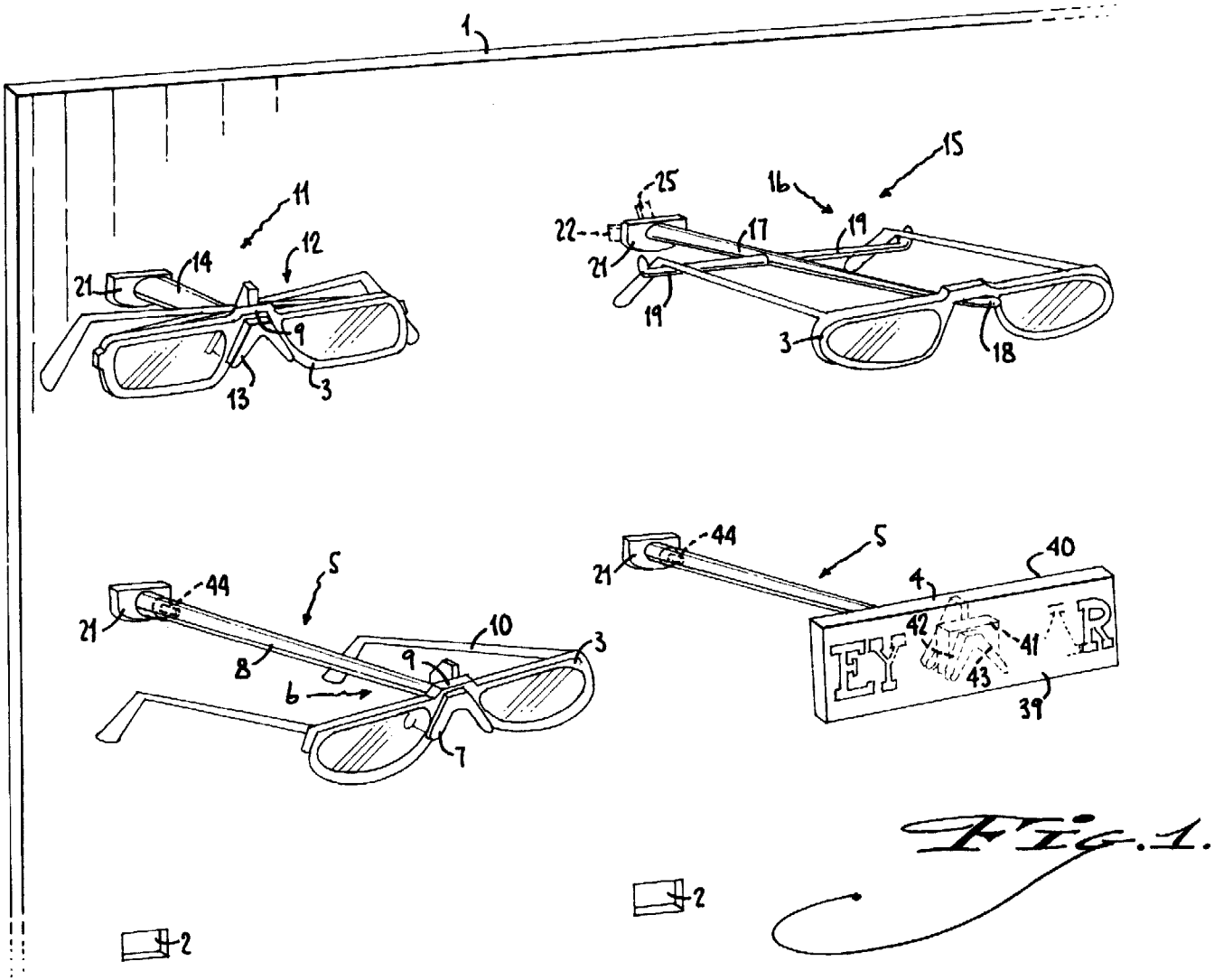

FIG. 1 is an isometric view of a preferred embodiment of this invention illustrating three different types of fixtures for displaying eyeglasses and eyeglass frames or other articles in the display system of this invention. As shown in FIG. 1, the display system of this embodiment comprises a substantially vertical display panel 1, which preferably is a rectangular sheet, rods, or a lattice of a thin plastic, aluminum, wood or other similar paneling material (e.g., 3mm thick). A suitable finish is provided on the front surface thereof, and the finish preferably reflects light from, e.g., overhead lighting, to provide substantial illumination for the displayed articles supported on fixtures which are mounted to the display panel. The display panel advantageously can be a clear plastic, or, if desired, an opaque material can be used.

The display panel defines a backdrop for the displayed articles. The display panel 1 can be attached to a wall of a display room or office, e.g., attached via support brackets (not shown). Likewise, the display panel can attach to or rest on the top surface of a display counter or table. The display panel may also extend at an angle other than vertical or horizontal (not shown).

As shown in FIG. 1, the display panel 1 of this embodiment is provided with a plurality of spaced rectangular apertures 2, preferably square in shape. The apertures can also have a variety of different geometric configurations such as in the shape of a rectangle, square, diamond, circle, triangle, or the like, only the rectangle being shown. The apertures 2 are preferably arranged in vertical and horizontal rows and/or columns to allow flexibility in arranging the display. The apertures can also be staggered or otherwise arranged in a variety of different arrays as desired, and it is possible to use certain apertures and not others for customizing the pattern of the array, for grouping frames of particular types, etc. The apertures 2 can be punched through the display panel 1 using appropriate die, punch and press equipment, or otherwise formed.

FIG. 1 illustrates three different types of fixtures according to the invention to display eyeglasses or eyeglass frames 3, or other accessories, such as display signs 4, in an attractive array having depth. One fixture 5 is provided to display opened eyeglasses or eyeglass frames 3, or also to display other accessories, the fixture 5 including a forward end 6 having an inverted U-shaped nose piece 7 (e.g., about 1.5 cm long) on the end of a generally elongated support rod portion 8 (e.g., about 15 cm long) which supports the nose bridge 9 and does not directly support the opened templar side arms 10 of a pair of opened eyeglasses or eyeglass frames 3. Another fixture 11, also illustrated in FIG. 1, is provided to display folded eyeglasses or eyeglass frames, or also to display other accessories, the fixture 11 including a forward end 12 having an inverted U-shaped nose piece 13 (e.g., 1.5 cm long) on the end of a generally elongated, but shorter support rod portion 14 relative to fixture 5 (e.g., 6 cm long). Rod portion 14 supports the bridge 9 and folded templar side arms 10 of a pair of folded eyeglasses or eyeglass frames 3.

Another fixture 15, also illustrated in FIG. 1, is provided to display opened eyeglasses or eyeglass frames 3, the fixture 15 including a forward end 16 in the form of a cross, the forward end 16 including a generally elongated support rod portion 17 (e.g., 15 cm long) having a forwardly extending nose portion 18 (e.g., 2.5 cm long) that supports the nose bridge 9 of an opened pair of eyeglasses or eyeglass frames 3 and also having a pair of extending side portions or cross arms 19 (e.g., each 8 cm long) bisecting the rod portion at a selected position along the length which support the opened templar side arms 10 of an opened pair of eyeglasses or eyeglass frames 3. Fixture 15 is especially preferred when used for displaying eyeglasses or eyeglass frames, since such fixture allows any type of frame, e.g., plastic, metal, wireless, etc., to sit at the same angle relative to any other frame of the same or different kind within the display system of the invention, thereby providing an advantageously attractive and organized presentation for comparison of the frames. The low surface area design of fixture 15 also allows for only minimal dust collection which is another advantage in the maintenance of the display system.

The fixtures 5, 11, and 15 are preferably made of light weight but attractive material such as a plastic material. The fixtures of the invention should have sufficient mechanical strength to withstand mounting and supporting forces without cracking, fracturing, breaking, or bending, and should also be easily molded in quantity to the desired shape and size (e.g., by injection molding or other plastic processing techniques), and resistant to discoloration, such as yellowing, due to exposure to light and age. Clear, and also opaque, Lexan® plastic is particularly preferred as the fixture material since it is substantially resistant to breaking and yellowing, and also is attractive and unobtrusive, whereby more attention can be paid to the eyeglasses or eyeglass frames. Other materials for the fixtures include clear or opaque acrylic plastic, Lucite® plastic, and the like, which are also particularly attractive in the display, readily molded in quantity to the desired shape and size, and unobtrusive.

As shown, the fixtures 5, 11, and 15 are generally horizontally elongated to display eyeglasses and eyeglass frames from a generally vertical display panel. The fixtures may also be angled, e.g, about ninety degrees (90°), along a portion thereof to display the manufactured articles from a generally horizontal display panel. Of course other angles between horizontal and vertical are possible as well, for example with the display panel attached at an acute angle to a base for resting on a horizontal surface, such that the display panel leans back from vertical and disposes the center of mass of the display over the base.

Three different types of eyeglass or eyeglass frame display fixtures are shown in FIG. 1. Other specific types of article display and support fixtures also can be used in the display system of this invention, namely either with similar structures for engaging other articles, such as a sign 4, or with different structures for engaging articles attached to the display panel in the manner discussed herein. Additionally, the article display fixtures and the display panel and apertures can be supplied with illumination means such that the display articles supported thereon are provided with substantial illumination.

As best illustrated in FIGS. 2–5, the rear end portion 20 of the fixtures 5, 11, and 15 is designed to allow the fixtures to be releasably attached to the display panel 1 via apertures 2 in the display panel, in a secure but releasable manner. The releasably attaching means on the rear end portion of the fixtures is particularly designed to provide a substantially stable and secure attachment to the display panel which resists detachment of the fixtures from the panel or breakage when displayed articles are supported on the fixtures, and which also provides minimal resistance when attaching and detaching the fixture from the panel such that other articles displayed within the display system are not otherwise disturbed.

Figure 3:
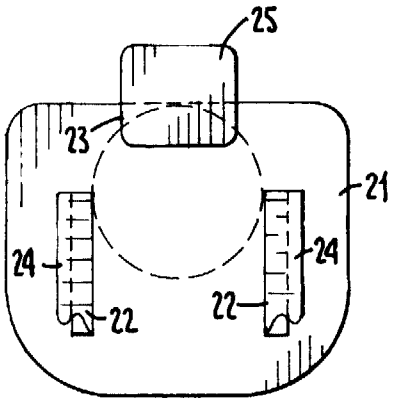
FIG. 3 is a rear view showing the rear end of a fixture of the invention, that fits into and engages an aperture in a display panel of the display system of the invention.

The rear end portion 20 comprises a face plate 21 adapted to fit against the front surface of the display panel 1 and to cover the aperture 2, abutting against the front face of the display panel adjacent aperture 2. In this embodiment, the face plate 21 is generally rectangular in shape with rounded corners, as illustrated in FIG. 3. The face plate 21 also can be made in other shapes, preferably of sufficient dimensions to cover aperture 2 fully and to engage against the display panel 1. Other regular or irregular geometric shapes, e.g., square, triangular, circular, etc. are possible, as are decorative shapes, for example resembling escutcheons, etc. Only the rectangular variation is shown for purposes of illustration.

In a preferred embodiment, the rear surface of face plate 21 is provided with a pair of opposed side lugs 22 and a flanged top clip 23, as illustrated in FIGS. 2–5. These engage display panel 1 on the back side adjacent aperture 2, and are opposed to the face plate 21 and to one another. Side lugs 22 and top clip 23 allow the fixture to be secured releasably to the display panel 1, locking the fixture to the display panel in conjunction with face plate 21. The relative positions of the flanged clip and lugs can be varied as well as the number of flanged clips and lugs to provide other satisfactory releasably engaging attachment means to the display panel apertures.

Figure 2:
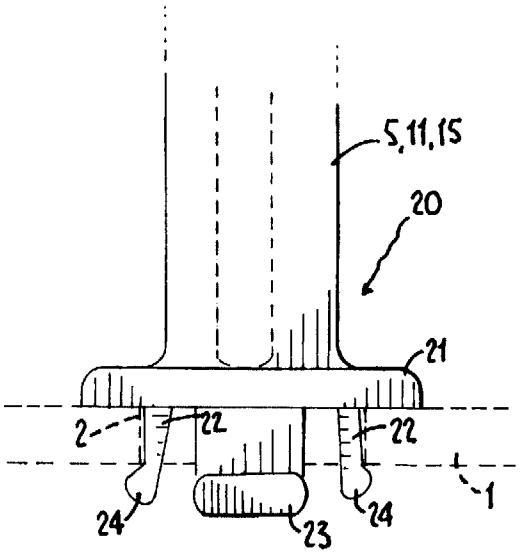
FIG. 2 is a top view showing the rear end of a fixture of the invention, that fits into and engages an aperture in a display panel of the display system of the invention.

As illustrated in FIG. 2, the side lugs 22 preferably are formed integrally with the back surface of the face plate 21. The side lugs 22 diverge outwardly at a slight angle from each other. The side lugs are formed of a thickness that allows a limited amount of resilient flexing of the lugs 22, to permit relatively easy insertion of the fixture into the aperture 2. During insertion, the side lugs are resiliently forced toward one another by the inside edges of aperture 2. When fully inserted, the lugs 22 open slightly to bear against the lateral edges of aperture 2. As shown in FIGS. 2–3, the side lugs 22 are also preferably provided with enlarged rounded ends 24 which are spaced from the rear surface of the face plate 21 by a distance substantially equal to the thickness of the display panel 2. The enlarged ends 24 of the side lugs 22 will thereby wrap around and engage the rear surface of the display panel 2 when the fixture is fully inserted into aperture 2 and hold the fixture securely in place. The opposed side lugs 22 can also be provided such that the side lugs are disposed at an angle relative to one another to engage an aperture of a display panel that is other than a rectangular or square shape, e.g., triangular in shape (not shown).

The flanged top clip 23 preferably is formed integrally on the rear end 20 of the fixture and is also designed to fit within the aperture 2 and helps to secure the fixture to the rear surface of the display panel 2 as a result of having the flange portion 25 spaced from the rear surface of the face plate 21 by a distance substantially equal to the thickness of the display panel. The width of the flanged top clip 23 is preferably just slightly less than the width of the aperture 2, so that when the rear end 20 of the fixture is inserted in the aperture 2, the flanged top clip 23 contacts the periphery of the top of the aperture 2 and permits only minimal lateral movement of the fixture, when attached to the display panel 1.

The flanged top clip 23 provides a secure engagement of the upper part of the fixture to the display panel. Clip 23 abuts display panel 1 on the rear side and positively resists the tendency for a load cantilevered on the fixture at a distance from the front of the display panel to cause the fixture to sag downwardly around a horizontal axis along the bottom edge of aperture 2. Thus, in conjunction with the face plate 21 and the side lugs 22, the flanged clip 23 ensures that the fixture is correctly oriented relative to the display panel, normally extending horizontally to support an eyeglass frame or similar article.

Figure 5:
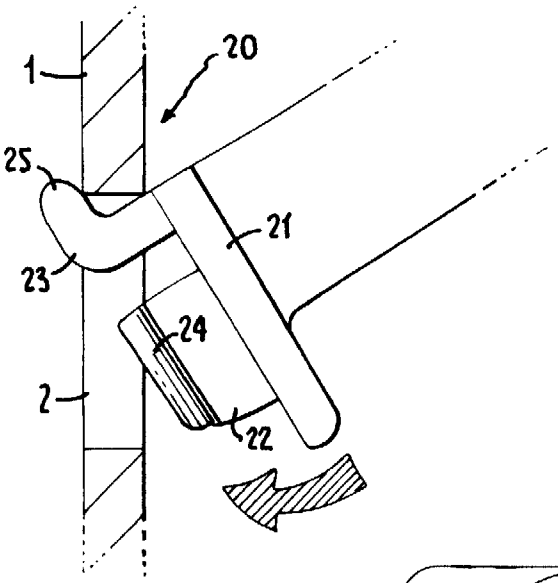
FIG. 5 is a side view showing insertion of the rear end of the fixture of the invention, that fits into and engages an aperture in a display panel of the display system of the invention.

The rear end 20 of the fixture can be easily inserted into the selected aperture 2 in the display panel 1 and locked in place. As shown in FIG. 5, the end with the flanged top clip 23 is first inserted into the aperture 2. Then by gently pushing face plate 21 to the rear, the side lugs 22 are forced by the edges of aperture 2 to deflect slightly toward each other, allowing them to fit into the aperture 2. Lugs 22 then spring outwardly with the enlarged ends 24 on the side lugs 22 locking the rear end 20 of the fixture tightly into place against the rear surface of the display panel 1.

Figure 4:
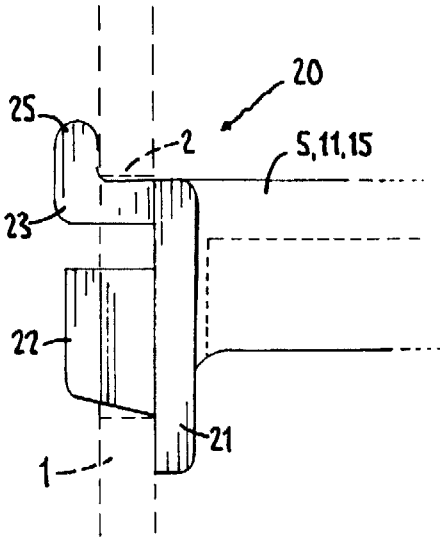
FIG. 4 is a side view showing the rear end of a fixture of the invention, that fits into and engages an aperture in a display panel of the display system of the invention.

Insertion of the rear end 20 can be facilitated by tipping the fixture initially, such that the top clip 23 is hooked around the top edge of the aperture upon insertion. The bottom edges of side lugs 22 can be inclined slightly as shown in FIGS. 4–5, such that as the fixture is more fully inserted the bottom edges push end 20 upwardly toward the top of aperture 2, thus better engaging top clip 23. In addition, top clip 23 can be inclined toward its distal end at rest, such that clip 23 is resiliently deflected downwardly upon insertion of end 20. Once the fixture is inserted in an aperture 2 of the display panel 1, rear end 20 substantially occupies the space of aperture 2, and locking side lugs 22 and top clip 23 provide a sturdy and stable arrangement such that when an article is displayed on the forward end of the fixture, the rear end 20 cannot disengage from the display panel 1 with downward vertical pressure on the fixture. As inserted, rear end 20 engages between the top and bottom edges of aperture 2 due to opposition of top clip 23 and the bottom edges of side lugs 22. Rear end 20 also engages between the lateral sides of aperture 2 due to opposition of side lugs 22. Although this lateral engagement is subject to the resilience of lugs 22, the extent to which end 20 is laterally displaceable is limited by the close fit of top clip 23 in aperture 2.

The rear end 20 of the fixture is easily removed from the display panel 1 by gently pulling on the elongated rod portion 8, 14, 17 of the fixtures with sufficient pressure to cause the side lugs 22 to deflect inwardly toward each other and allow the enlarged ends 24 to disengage from the rear surface of the display panel 1. This can be accompanied by upward pressure on the fixture at a distance from the display panel, which also causes top clip 23 to unhook from panel 1. Downward pressure is typical of loading from the weight of the eyeglasses or eyeglass flames, or other accessories, and the manual action of placing and removing the frames or other accessories normally only applies downward pressure on the support fixture (i.e., upward force on the frames simply lifts them from the support fixture). Thus the attachment of the fixture to display panel 1 is secure until the user deliberately detaches the fixture by upward pressure. Moreover, the rear end is designed for ease of detachment such that removal of one fixture does not substantially exert a pulling force on the entire display panel which tends to disrupt the other articles displayed on other fixtures within the display system.

Figure 6:
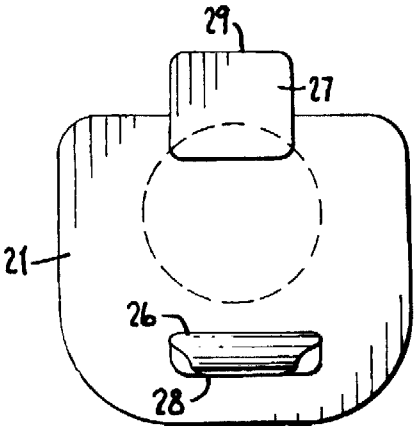
FIG. 6 is rear view showing an alternative rear end of a fixture of the invention, that fits into and engages an aperture in a display panel of the display system of the invention.
Figure 7:
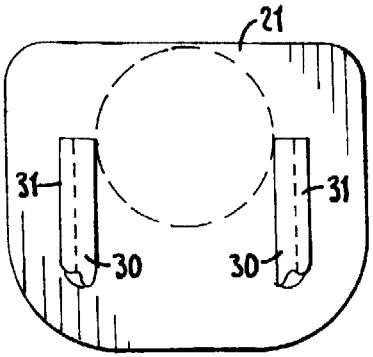
FIG. 7 is rear view showing another alternative rear end of a fixture of the invention, that fits into and engages an aperture in a display panel of the display system of the invention.

As illustrated in FIGS. 6–7, alternative arrangements for the rear end portion 20 of the fixtures 5, 11, and 15 can be used which are similarly designed to allow the fixtures to be releasably attached to the display panel 1 via apertures 2 in the display panel, in a secure but releasable manner. As shown in FIG. 6, one alternative embodiment has the rear surface of face plate 21 provided with display panel attachment means including a bottom lug 26 and a flanged top clip 27. The bottom lug 26 and top clip 27 engage display panel 1 on the back side adjacent aperture 2, and are opposed to the face plate 21 and to one another. The bottom lug 26 and top clip 27 allow the fixture to be releasably secured to the display panel 1, locking the fixture to the display panel in conjunction with face plate 21.

In this embodiment, the bottom lug 26 preferably is formed integrally with the back surface of the face plate 21, diverges outwardly at an angle, and is formed of a thickness that allows a limited amount of resilient flexing of the bottom lug 26, to permit relatively easy insertion of the fixture into the aperture 2, whereupon the bottom lug is resiliently forced inward by the inside edges of aperture 2 of the display panel. When fully inserted, the bottom lug 26 opens slightly to bear against the bottom edge of aperture 2. The bottom lug 26 is also preferably provided with an enlarged rounded end 28 which is spaced from the rear surface of the face plate 21 by a distance substantially equal to the thickness of the display panel 2. The enlarged end 28 of the bottom lug will thereby wrap around and engage the rear surface of the display panel 2 when the fixture is fully inserted into aperture 2 and hold the fixture securely in place.

The flanged top clip 27 preferably is formed integrally on the rear end 20 of the fixture and is also designed to fit within the aperture 2 and helps to secure the fixture to the rear surface of the display panel 2 as a result of having the flange portion 29 spaced from the rear surface of the face plate 21 by a distance substantially equal to the thickness of the display panel. The width of the flanged top clip 27 is preferably just slightly less than the width of the aperture 2, so that when the rear end 20 of the fixture is inserted in the aperture 2, the flanged top clip 27 contacts the periphery of the top of the aperture 2 and permits only minimal lateral movement of the fixture, when attached to the display panel 1. The flanged top clip 27 provides a secure and stable engagement of the upper part of the fixture to the display panel. The flanged top clip 27 abuts display panel 1 on the rear side and positively resists the tendency for a load cantilevered on the fixture at a distance from the front of the display panel to cause the fixture to sag downwardly around a horizontal axis along the bottom edge of aperture 2. Thus, in conjunction with the face plate 21 and the bottom lug 26, the flanged top clip 27 ensures that the fixture is correctly oriented relative to the display panel, normally extending horizontally to support an eyeglass frame or similar article.

Another alternative embodiment of the attachment means is illustrated in FIG. 7. In this embodiment, the rear end of the face plate 21 is provided with a pair of opposed side lugs 30. The opposed side lugs engage display panel 1 on the back side adjacent aperture 2, and are opposed to the face plate 21 and to one another. The opposed side lugs 30 alone allow the fixture to be releasably secured to the display panel 1, locking the fixture to the display panel in conjunction with face plate 21. The side lugs 30 preferably are formed integrally with the back surface of the face plate 21 diverge outwardly at a slight angle from each other, and are formed of a thickness that allows a limited amount of resilient flexing of the side lugs 30, to permit relatively easy insertion of the fixture into the aperture 2, whereupon the side lugs are resiliently forced toward one another by the inside edges of aperture 2. When fully inserted, the side lugs 30 open slightly to bear against the lateral edges of aperture 2. The side lugs 30 are also preferably provided with enlarged rounded ends 31 which are spaced from the rear surface of the face plate 21 by a distance substantially equal to the thickness of the display panel 2. The enlarged ends 31 of the side lugs 30 will thereby wrap around and engage the rear surface of the display panel 2 when the fixture is fully inserted into aperture 2 and hold the fixture securely in place.

As best illustrated in FIGS. 8–10, the elongated support rod portions and the forward ends of the three different types of fixtures 5, 11, and 15 for displaying eyeglasses and eyeglass frames or other accessories are shown. FIG. 8 illustrates a fixture 15 preferably formed integrally with the front surface of face plate 21 having a forward end 16 in the form of a cross for supporting eyeglasses and eyeglass frames in an opened position. The forward end 16 of fixture 15 is formed of an elongated rod portion 17 preferably of a generally circular cross section and of a sufficient length and diameter to support the frames in an opened position. The elongated support rod portion 17 of fixture 15 also preferably includes an elongated channel 32 on the underside thereof, as illustrated in FIG. 10. The elongated rod portion 17 of fixture 15 terminates in a forwardly extending nose portion 18 preferably formed integrally with the rod portion 17 for supporting the nose bridge 9 of eyeglasses or eyeglass frames 3.

The elongated rod portion 17 further includes a pair of elongated cross arms 19, preferably formed integrally with the rod portion and preferably of a generally circular cross section and of a length sufficient to support the span of the templar side arms 10 of the frames 3 in an opened position, which bisect the rod portion at a selected position along the length for supporting the templars of the eyeglasses or eyeglass frames. The cross arms 19 of fixture 15 preferably terminate in upwardly extending fins 33 which provide an abutment for the templar side arms 10 of the eyeglass frames 3 supported thereon. The forward extending portion 18 of fixture 15 also preferably includes a slot 34 which provides a nest for the bridge 9 of the eyeglass frames 3 and consequently allows the frames to be displayed in a securer manner. This embodiment is particularly used to support eyeglasses or eyeglass frames in an opened position, having the templar side arms thereof supported on the cross arms 19 and the nose bridge thereof supported on the forwardly extending nose portion 18.

This generally T-shaped fixture 15 is advantageous for displaying eyeglasses and eyeglass frames due to its minimal structural design which allows the frames to be seen by a viewer in their entireties without being hidden behind structurally obtrusive supporting fixtures. Moreover, this fixture is particularly preferred for displaying eyeglasses and eyeglass frames, since it allows frames of any type, e.g., plastic, metal, wireless, etc., to be displayed at the same angle relative to adjacent frames displayed on similar fixtures on the display panel, and also minimizes dust collection, thereby providing an attractive, unobtrusive, organized and easily maintained display system.

FIG. 9 illustrates fixture 5 or fixture 11, each fixture preferably formed integrally with the front surface of face plate 21 and having a forward end 6, 12 in the form of a horseshoe. The forward end of fixtures 5 and 11 includes an elongated support rod portion 8, 14 preferably of a generally circular cross section and preferably of a longer length when used to support eyeglasses or eyeglass frames 3 in a opened templar position as in fixture 5 and a shorter length when used to support eyeglasses or eyeglass frames in a folded templar position as in fixture 11. The elongated support rod portion terminates in an inverted U-shaped nose piece 7, 13 preferably of sufficient shape and size to support a nose bridge of eyeglasses or eyeglass frames thereon, or for supporting other accessories having an engagement portion in the shape of a nose bridge of an eyeglass frame.

Fixture 5 is used to support eyeglasses or eyeglass frames 3 in an opened position, having the opened templar side arms 10 fully extended and dangled in the air and the nose bridge 9 thereof supported on the inverted U-shaped nose-piece 7. Fixture 11 is of similar design as fixture 5, except for the shorter support rod portion, and is used to support eyeglasses or eyeglass frames 3 in a folded position, having the folded templar side arms 10 supported on a generally shorter elongated support rod 14 and the bridge 9 thereof supported on the U-shaped nose-piece 13. The elongated support rod 8, 14 terminates in the inverted U-shaped nose piece which includes a forward end inverted U-shaped portion 35 and a rear end inverted U-shaped portion 36 on the elongated support rod, the two portions being spaced apart a distance sufficient to support therebetween a nose bridge of eyeglasses or eyeglass frames, or similarly structured articles.

The spaced apart inverted U-shaped portions 35 and 36 of nose piece 7, 13 are adjoined by a generally horizontal nose rod 37, preferably an inverted U-shaped nose rod, to provide a nesting portion for the nose bridge of the frames. The front end inverted U-shaped portion 35 is preferably designed to have slightly greater dimensions in height and width than the nesting nose portion 37 in order that the frames have a forward abutment, but minimal enough such that the frames are minimally concealed at the bridge of the frame and, consequently, are not substantially hidden or obstructed behind the forward end inverted U-shaped portion 35 of the nose piece. The rear end inverted U-shaped portion 36 includes an upwardly and forwardly extending fin 38 to engage the rear of the nose bridge of the frames and, consequently, to support the frames in a substantially horizontal position.

Fixtures 5 and 11 can also be used in the invention to support other articles, e.g., signs, shelves, photographs, lenses, lens tints, and other accessories which are desirable to be displayed in the display system of the invention. As illustrated in FIG. 1, the inverted U-shaped nose piece of these fixtures can not only be used to support the nose bridge of eyeglasses and eyeglass frames, but also can be used to support other articles, for instance a display sign 4 having printed indicia thereon such as eyewear, sunwear, etc., or a graphic display such as in the shape of a sun (not shown). As illustrated, the sign can be of a generally rectangular shape having a front surface 39 for displaying a message and a rear surface 40 including engagement means for engaging the nose piece of the fixture. The engagement means is generally in the shape of a nose bridge of eyeglass frames and includes an extending portion 41 from the rear surface of the sign connected to a downwardly extending face plate 42 which is parallel to and spaced apart from the rear surface of the sign. The downwardly extending face plate 42 includes an inverted U-shaped opening 43 which simulates the shape of a nose bridge of eyeglass frames and is used as the engagement means to engage the nose piece 7, 13 of the fixtures 5, 11. Other articles, for example, shelves, photograph holders, graphic works, lens holders, lens tint holders, and the like can similarly be provided with engagement means to engage the nose piece of the fixtures.

The forward ends of the fixtures 5, 11, and 15 of the invention used for supporting and engaging articles, such as eyeglasses or eyeglass frames or other articles, can also be provided as a separate non-integral and detachable unit, as illustrated in FIG. 1, that is attached to the rear end of the fixture at a selected detachable segment 44 remote from the forward end article supporting end, e.g., lockable on the fixture by a snap connection, adhesively affixed (not shown), etc. The specific structure of the portion of fixtures that engages the frames or other articles is subject to variation and there are a number of alternatives. The invention is applicable to all variations of the frame engagement structure, and is particularly advantageous in conjunction with frame engagement structures that allow the frames to be lifted freely away vertically.

FIGS. 11–20 show another embodiment of the invention, where fixture 15, i.e., the generally T-shaped fixture, further includes a security strap or cable 45 for attaching the eyeglasses or eyeglass frames to the fixture. This is particularly advantageous when displaying more expensive eyeglasses or eyeglass frames, and/or to prevent the frames from being inadvertently upset when a customer reaches for an adjacent pair of eyeglasses or frames. The security cable 45 is designed releasably and lockingly to engage around nose bridge 9 of eyeglasses or eyeglass frames 3, attaching them to the fixture 15 via a locking band and loop arrangement such that the frames cannot be removed as easily. For example, the locking cable can be such as to require customer assistance by the attendant.

Figure 13:
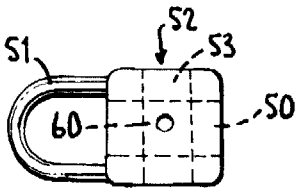
FIG. 13 is a top view along line XIII—XIII of FIG. 12 showing the security cable engaging the nose bridge of the glasses or frames.
Figure 14:
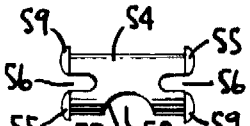
FIG. 14 is a side view showing the locking means for the security cable of the invention, that locks with the front end of a fixture.
Figure 15:
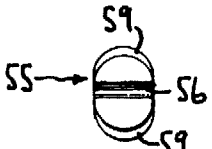
FIG. 15 is a front view showing the locking means for security cable of the invention, that lockingly engages that front end of a fixture to the security cable.
Figure 12:
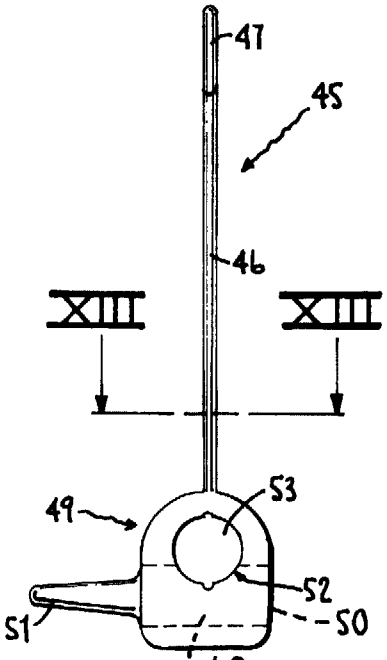
FIG. 12 is a side view showing a security band or cable according to an aspect of the invention, that engages around a nose bridge of eyeglasses or frames to hold the glasses or frames at the forward end of a fixture as described.
Figure 11:
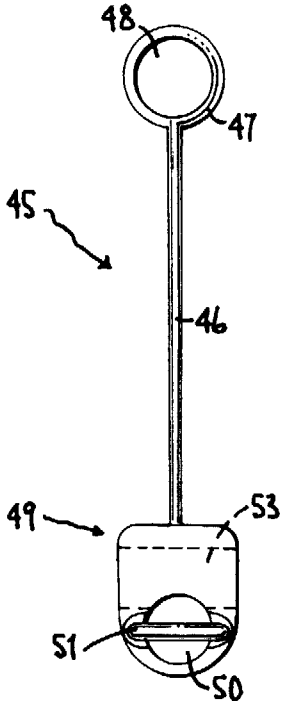
FIG. 11 is a front view showing a security cable of the invention, that locks over a nose bridge of eyeglasses or eyeglass frames to affix them the forward end of a fixture of the invention.

As shown in FIGS. 11–13, the security cable 45 includes an elongated cable portion 46 preferably made of strong, flexible, and resilient materials, for instance nylon, plastic, rubber, metal or alloy wire, or the like. The cable portion 46 terminates at a rear end in a band portion 47 having an opening 48, and the band portion 47 is preferably made of the same strong, resilient and flexible material as the cable portion and preferably is formed integrally with the cable portion. The band portion 47 and the band opening 48 are provided in sufficient size and shape, preferably of a generally circular shape, to receive the forwardly extending nose portion 18 of fixture 15 inserted therein.

The cable portion 46 terminates at a forward end in a retainer portion 49. The retainer portion includes a rear opening 50 and terminates in a closed retainer loop 51 for nesting the terminus of the nose portion 18 thereon. The retainer loop 51 can include a slot (not shown) for receiving the terminus of the nose portion 18 therein, and the retainer loop can also be completely enclosed (not shown). The rear opening 50 is provided in a sufficient size and shape, preferably of a generally circular shape, to receive the forwardly extending nose portion 18 of fixture 15 inserted therein. The retainer portion 49 is preferably formed integrally with the cable portion and is preferably made of the same strong, resilient and flexible material as the cable portion.

The retainer portion 49 further includes a locking means or retaining means 52 to hold the retainer portion of the security cable 45 on fixture 15 and also to lockingly engage the nose portion 18 of fixture 15 and a nose bridge 9 of an eyeglass or eyeglass frame 3 supported thereon. The locking means 52 on the retainer portion 49 includes a lateral bore 53, in the retainer portion 49 which is positioned between the rear opening 50 and the retainer loop 51 and generally extends through the retainer portion 49 transverse to the rear opening 50 and the retainer loop 51. Also, the lateral bore 53 is positioned such that a selected portion 54 of the bore 53 bisects the pathway 60 between the rear opening 50 and the retainer loop 51. The lateral bore 53 is provided in a size and shape, preferably of a generally circular shape, to receive a lock pin 54.

As shown in FIGS. 14–15 and FIGS. 18–20, the lock pin 54 is an elongated member, preferably made of a flexible, resilient, and relatively hard material, such as nylon, plastic, or rubber, having a length, approximately the length of the bore 53, and is preferably of a generally cylindrical shape having a diameter of sufficient size to fit within the lateral bore 53. The lock pin terminates in two ends 55 that each include slots 56 that can receive a key, such as a flathead of a screwdriver, to move the lock pin between a locked and unlocked position or, in other words, a secured and unsecured position. The lock pin 54 also includes an arch 57 having an opening 58 which extends through a selected portion of the lock pin transverse to its length. The two ends 55 of the lock pin 54 are preferably also provided with enlarged rounded ends 59 integral with the slots 56. The enlarged rounded ends 59 are slightly greater in diameter than the lateral bore 53 such that when the lock pin 54 is inserted in the lateral bore 53 the enlarged rounded ends 59 are resiliently flexed and deflected inward to provide an interference fit within the lateral bore 53.

Figure 18:
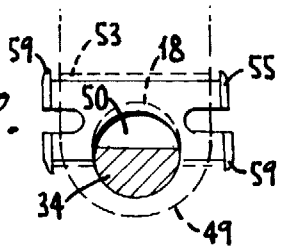
FIG. 18 is a section view of the security cable of the invention, showing the locking means in its locked state.
Figure 19:
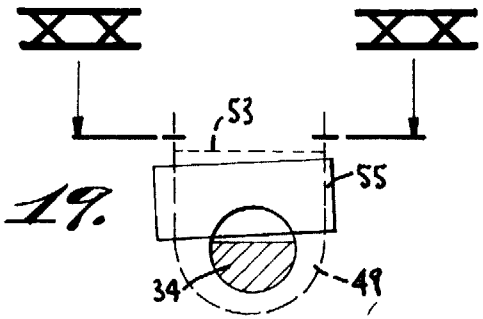
FIG. 19 is a section view of the security cable of the invention, showing the locking means in its unlocked state; and, FIG. 20 a top view along line XX—XX of FIG. 19, showing the insertion of the locking means when in the unlocked position into the security cable.
Figure 20:
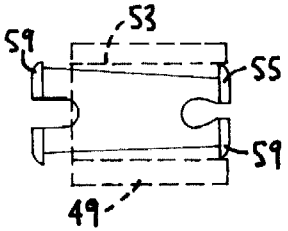

As shown in FIGS. 19–20, the lock pin 54 when inserted in or removed from the lateral bore 53 of the security cable retainer portion 49 is preferably rotatably aligned, as shown, such that arch opening 58 portion is positioned not to interfere with either the nose portion 18 or slot 34 of fixture 15 located in the pathway 60 between the rear opening 50 and retainer loop 51 of the security cable retainer portion 49, to define an unlocked position. Also, the lock pin 54 when inserted is forced within the lateral bore 53 such that enlarged ends 59 are resiliently flexed inward while the length of the lock pin 54 is passed over the slot of the fixture 15. Thus, after the nose portion 18 of the fixture 15 has been inserted in the retainer portion 49 of the security cable 45 along with the lock pin 54 in the lateral bore 53 of the retainer portion 49, as previously described, the slot 34 of the nose portion 18 of fixture 15 is generally positioned under the lateral bore 53 of the retainer portion 49. Accordingly, when the lock pin 54 is rotated, about 90°, 180°, or 270°, as shown in FIG. 18, for instance, by using the flathead of a screwdriver on the slotted ends 55, the lock pin 54 becomes aligned such that the arch opening 58 is concentric with the retainer portion pathway 60 between the rear opening 50 and retainer loop 51, to define a locked position. This alignment thereby provides an interference fit between the inner walls of the arch 57 which are resiliently flexed outward and the slot 34, and also provides restricted pathway 60 formed over the slot 34 of reduced diameter of fixture 15, which accordingly prevents the rear opening 50 of the retainer portion 49 from disengaging over the nose portion 18 of fixture 15. A lock is therefore formed between the nose portion 18 of the fixture 15 and the retainer portion 49 of the security cable 45. Of course, other locking arrangements are possible as well. The specific structure of the locking means of the security cable is subject to variation and there are a number of possible alternatives. The invention is applicable to all variations of the locking structure.

Figure 16:
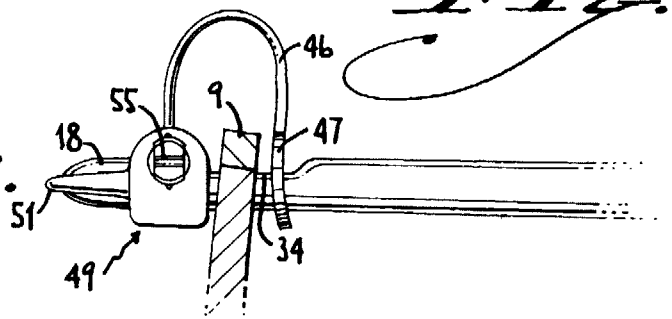
FIG. 16 is a side view showing the operation of the security cable of the invention, that fits over the front end of a fixture of the invention and lockingly engages a nose bridge of an eyeglass or eyeglass frame positioned between the security cable to the fixture.
Figure 17:
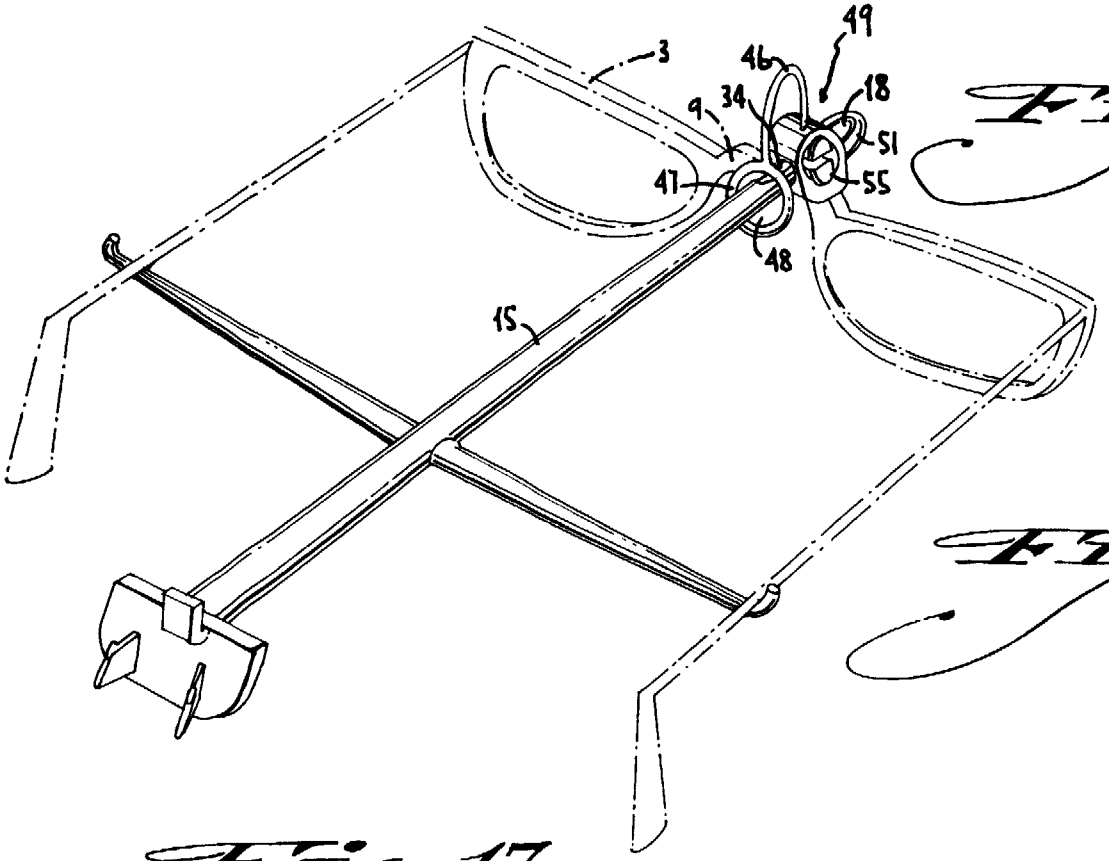
FIG. 17 is an isometric view showing the operation of the security band or cable of the invention.

As illustrated in FIGS. 16–17, the band 47 of the security cable 45 is first placed around the forwardly extending end 18 of the fixture 15 and back along fixture 15 to a point to the rear of the position where the nose bridge 9 of eyeglasses or eyeglass frames 3 will rest. After the forwardly extending end 18 of the fixture 15 is inserted into the band opening 48 of the security cable 45, an eyeglass or eyeglass frame 3 is placed by the nose bridge 9 on the fixture 15 at a location on the front end 18, in front of the band portion 47, preferably at the nesting slot 34. Once the eyeglass or eyeglass frame 3 is supported on the fixture 15 and nested within slot 34, the retainer 49 of the security cable 45 is fitted over the forwardly extending end 18 of the fixture 15 until the foremost end of the forwardly extending end or nose portion 18 is retained by the retainer loop 51 and the slot 34 is preferably positioned under the lateral bore 53. Upon this assembly, the cable portion 46 of the security cable 45 is caused to arch over the nose bridge 9 of the eyeglass or eyeglass frame 3 such that the frame 3 cannot be removed from the fixture 15. Once the forward nose portion 18 of the fixture 15 is inserted into the retainer 49, the lock pin 54 is inserted in the lateral bore 53 such that the archway opening 58 is preferably away from the nose portion 18 of the fixture 15 and is then rotated to align the arch opening 58 with the slot 34 in order to interferencely lock the security cable 45 to the fixture 15 and thus positively retain the eyeglass or eyeglass frame 3 via the security cable 45 to the fixture 15.

The invention having been disclosed in connection with the foregoing variations, additional variations will now be apparent to persons skilled in the art. The invention is not intended to be limited to the variations specifically mentioned, and accordingly reference should be made to the appended claims rather than the foregoing discussion to assess the spirit and scope of the invention in which exclusive rights are claimed.

We claim:

1. A display system for manufactured articles, comprising: a display panel having at least one aperture formed therein and at least one manufactured article holding fixture, the fixture having a forward end adapted to hold the manufactured article in a position for display and a rear end having a face plate adapted to contact the front surface of the display panel around the periphery of a selected aperture, a pair of opposed side lugs and a flanged top clip in which the opposed side lugs are inclined along a bottom edge thereof opposite from the flanged top clip, the side lugs and the top clip being integral with the face plate and dimensioned such that upon insertion into the same said selected aperture, the bottom edge of the side lugs bears against a corresponding edge of the selected aperture to force the top clip upwardly against an opposite edge of the selected aperture so as to reasonably secure to fixture to the display panel.

2. The display system of claim 1, in which the display panel includes a plurality of spaced apertures and a plurality of manufactured article holding fixtures adapted to fit within a selected aperture.

3. The display system of claim 1, in which the display panel is generally vertical.

4. The display system of claim 1, in which the aperture is rectangular, square, circular or triangular.

5. The display system of claim 1, in which the opposed side lugs diverge outwardly from each other.

6. The display system of claim 1, in which the opposed side lugs have enlarged ends spaced from the rear surface of the face plate a distance substantially equal to the thickness of the display panel.

7. The display system of claim 1, in which the flange on the top clip is spaced from the rear surface of the face plate a distance substantially equal to the thickness of the display panel.

8. A fixture for displaying an eyeglass or eyeglass frame on a display panel, the fixture comprising: a forward end adapted to hold the eyeglass or eyeglass frame in a position for display in which the forward end includes an elongated rod portion having a forwardly extending nose portion and bisecting cross arms for supporting the eyeglass frames in an opened templar side arm position and a rear end having a face plate adapted to contact the front surface of the display panel around the periphery of an aperture in the display panel, a pair of opposed side lugs and a flanged top clip adapted to fit within the same said selected aperture in the display panel and engage portions of the periphery of the aperture and the rear surface of the display panel to releasably secure the fixture to the display panel.

9. The fixture of claim 8, in which the ends of the cross arms terminate in upwardly extending fins to engage the opened templar side arms of the eyeglass frames.

10. The fixture of claim 8, in which the forward extending portion includes a slot to nest the nose bridge of the eyeglasses or eyeglass frames.

11. The fixture of claim 8, in which the face plate is substantially rectangular, square, circular, triangular in shape.

12. The fixture of claim 8, in which the opposed side lugs diverge outwardly from each other.

13. The fixture of claim 8, in which the opposed side lugs have enlarged ends space from the rear surface of the face plate a distance substantially equal to the thickness of the display panel.

14. The fixture of claim 8, in which the opposed side lugs have inclined bottom edges that bear against an edge of the aperture opposite from the clip to urge the top clip against an opposite edge of the aperture upon full insertion of the fixture.

15. The fixture of claim 8, in which the flange on the top clip is spaced from the rear surface of the face plate a distance substantially equal to the thickness of the display panel.

16. A fixture for displaying a manufactured article on a display panel, the fixture comprising: a forward end adapted to hold the manufactured article in a position for display and a rear end having a face plate adapted to contact the front surface of the display panel around the periphery of an aperture in the display panel, the face plate having a pair of opposed side lugs and a flanged top clip adapted to fit within the same said selected aperture in the display panel and engage portions of the periphery of the aperture and the rear surface of the display panel to releasably secure the fixture to the display panel.

17. A generally horizontal fixture for displaying eyeglasses and eyeglass frames on a generally vertical display panel, the fixture comprising: a generally horizontal forward end adapted to hold the eyeglasses or eyeglass frames in a position for display having an elongated rod including a forward extending nose portion with a slot at the forward end and bisecting cross arms with generally vertically extending fins and a rear end face plate having a pair of opposed side lugs and a flanged top clip adapted to fit within an aperture in the display panel and engage portions of the periphery of the aperture and the rear surface of the display panel to releasably secure the fixture to the display panel.

18. The fixture of claim 11, in which the opposed side lugs diverge outwardly from each other and have enlarged ends spaced from the rear surface of the face plate a distance substantially equal to the thickness of the display panel and the flange on the top clip is spaced from the rear surface of the face plate a distance substantially equal to the thickness of the display panel.

19. The fixture of claim 18, in which the opposed side lugs have inclined bottom edges that bear against an edge of the aperture opposite from the top clip to urge the top clip against an opposite edge of the aperture upon full insertion of the fixture.

20. A display system for eyeglasses or eyeglass frames, comprising: a display panel having at least one aperture formed therein and at least one manufactured article holding fixture, the fixture having a forward end adapted to hold the manufactured article in a position for display and a rear end having a face plate adapted to contact the front surface of the display panel around the periphery of the same said selected aperture, a pair of opposed side lugs and a flanged top clip in which the opposed side lugs are inclined along a bottom edge thereof opposite from the flanged top clip, the side lugs and the top clip being integral with the face plate and dimensioned such that upon insertion into the aperture, the bottom edge of the side lugs bears against a corresponding edge of the aperture to force the top clip upwardly against an opposite edge of the aperture.

21. The display system of claim 20, in which the display panel includes a plurality of spaced apertures and a plurality of manufactured article holding fixtures adapted to fit within a selected aperture.

22. The display system of claim 20, in which the display panel is generally vertical.

23. The display system of claim 20, in which the aperture is rectangular, square, circular or triangular.

24. The display system of claim 20, in which the opposed side lugs diverge outwardly from each other.

25. The display system of claim 20, in which the opposed side lugs have enlarged ends spaced from the rear surface of the face plate a distance substantially equal to the thickness of the display panel.

26. The display system of claim 20, in which the flange on the top clip is spaced from the rear surface of the face plate a distance substantially equal to the thickness of the display panel.

27. The display system of claim 20, in which the forward end includes an elongated rod having a forwardly extending nose portion and bisecting cross arms for supporting the eyeglass frames in an opened templar side arm position.

28. The display system of claim 20, in which the forward end includes an elongated rod having a forward extending portion of two spaced apart inverted generally U-shaped portions adjoined by an inverted generally U-shaped nose portion for supporting the eyeglass frames in an opened or folded templar side arm position.

* * * * *

UNITED STATES PATENT AND TRADEMARK OFFICE

CERTIFICATE OF CORRECTION

PATENT NO. : 5,593,045

DATED : January 14, 1997

INVENTOR(S) : James B. Eldon, III et al

It is certified that error appears in the above-indentified patent and that said Letters Patent is hereby corrected as shown below:

Column 1, line 8, delete "flames" and substitute therefor --frames--.
Column 1, line 11, delete "flames" and substitute therefor --frames--.
Column 1, line 14, delete "flames" and substitute therefor --frames--.
Column 1, line 17, delete "flames" and substitute therefor --frames--.
Column 8, line 31, delete "flames" and substitute therefor --frames--.
Column 14, Claim 13, line 61, delete "space" and substitute therefor --spaced--.
Column 14, claim 14, line 66, after the first instance of "the", insert --top--.
Column 15, Claim 18, line 27, delete the numeral 11 and substitute therefor --17--.

Signed and Sealed this

Twenty-second Day of July, 1997

Bruce Lehman

*Attest:*

BRUCE LEHMAN

*Attesting Officer*

*Commissioner of Patents and Trademarks*